US008509035B2

(12) United States Patent
Philippine

(10) Patent No.: US 8,509,035 B2
(45) Date of Patent: Aug. 13, 2013

(54) CALENDAR DISPLAY DEVICE AND CALENDAR WATCH

(75) Inventor: Thibaut Philippine, Vallorbe (CH)

(73) Assignee: Societe Anonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 107 days.

(21) Appl. No.: 13/286,535

(22) Filed: Nov. 1, 2011

(65) Prior Publication Data

US 2012/0106302 A1 May 3, 2012

(30) Foreign Application Priority Data

Nov. 2, 2010 (CH) ..... 1826/10
Nov. 2, 2010 (CH) ..... 1827/10

(51) Int. Cl.
*G04B 19/247* (2006.01)

(52) U.S. Cl.
USPC ..... 368/37; 368/28; 368/35

(58) Field of Classification Search
USPC ..... 368/28, 34–38, 77, 221, 233
See application file for complete search history.

(56) References Cited

U.S. PATENT DOCUMENTS

| | | | | |
|---|---|---|---|---|
| 31,612 A | | 3/1861 | Maranville | |
| 165,840 A | | 7/1875 | Kellogg | |
| 340,855 A | | 4/1886 | Blanchard | |
| 1,894,470 A | | 1/1933 | Mathers | |
| 2,014,168 A | | 9/1935 | Canepa | |
| 3,712,043 A | * | 1/1973 | Egger et al. | 368/37 |
| 3,760,585 A | * | 9/1973 | Wein | 368/35 |
| 4,285,148 A | | 8/1981 | Kolar | |
| 6,160,766 A | * | 12/2000 | Chiang | 368/37 |
| 2012/0106301 A1 | | 5/2012 | Philippine | |

FOREIGN PATENT DOCUMENTS

| | | |
|---|---|---|
| CH | 24914 | 3/1903 |
| CH | 235071 | 11/1944 |
| CN | 2063657 U | 10/1990 |
| DE | 512784 | 11/1930 |
| EP | 0285881 A1 | 12/1988 |
| EP | 1351104 A1 | 10/2003 |
| EP | 1351105 A1 | 10/2003 |
| GB | 1406718 | 9/1975 |
| JP | 53012375 U | 2/1978 |
| WO | WO 2008/044117 A2 | 4/2008 |

OTHER PUBLICATIONS

Article "Cuervo y Sobrinos Historiador Semanal" on http://www.worldtempus.com, Nov. 28, 2009, 2 sheets.

* cited by examiner

*Primary Examiner* — Vit W Miska
*Assistant Examiner* — Matthew Powell
(74) *Attorney, Agent, or Firm* — Patterson Thuente Pedersen, P.A.

(57) ABSTRACT

A calendar display device for a mechanical watch piece including a first disk, the disk of days, carrying multiple series of inscriptions symbolizing the seven days of the week, a second disk, the disk of dates, carrying inscriptions symbolizing the date of the month, a third disk, the disk of months, carrying 12 inscriptions symbolizing the months of the year. One of the disk of days and the disk of dates acts as a dial by being fixed, whereas the other acts as a rotary disk by being arranged concentrically and rotatably in relation to the dial. The dial includes an aperture making it possible to see the inscription of the current month on the disk of months. A hand indicates simultaneously the date and the day of the week. The device includes a correction mechanism cooperating at least with a gear train bidirectionally driving the disk of months.

19 Claims, 7 Drawing Sheets

CALENDAR DISPLAY DEVICE AND CALENDAR WATCH

RELATED APPLICATION

The present application claims priority to Swiss Application No. CH 01827/10 filed Nov. 2, 2010, and Swiss Application No. CH 01826/10 filed Nov. 2, 2010, each of which is hereby fully incorporated herein by reference.

FIELD OF THE INVENTION

The present invention relates to a calendar display device, in particular for a mechanical watch piece comprising a watch movement, comprising a first disk, the disk of days, carrying multiple series of inscriptions symbolizing the seven days of the week, a second disk, the disk of dates, carrying inscriptions symbolizing the date of the month, a third disk, the disk of months, carrying 12 inscriptions symbolizing the months of the year, one of the disk of days and the disk of dates acting as a dial by being fixed, whereas the other acts as a rotary disk by being arranged concentrically and rotatably in relation to said dial, said dial comprising an aperture which makes it possible to see the inscription of the current month on the disk of months which is rotatably mounted and is driven by the watch movement of said watch piece, and a hand placed concentrically and rotatably in relation to said dial so as to simultaneously indicate the date and the day of the week. The present invention also relates to a watch piece comprising such a calendar display device.

BACKGROUND

Watch pieces comprising such a calendar display belong to the category of watch pieces referred to as "complicated time pieces" and allow the user to view, by a single glance at the dial of the watch piece, information relating to the day, date and month, more specifically with a view of the entire current month. Documents DE 25 267 and U.S. Pat. No. 340,855 are typical examples of this type of device. These devices afford the notable advantage of very conveniently providing the information of which day of the week corresponds to which date for an entire month. However, owing to the fact that the length of each of the months is not generally a multiple of 7, the length of a week, these devices pose the significant drawback that they require the manual intervention of the user at the start of each month in order to readjust the inscriptions on the scale of days with the inscriptions on the scale of dates, otherwise the calendar display would no longer be correct.

Within the field of date display and, in general, of displaying calendar data, mechanisms called "perpetual calendars" by the person skilled in the art are also known. This type of mechanism is normally pre-programmed by using cams representing the length of the months and makes it possible to display the day, the date, the month and possibly the year for long periods, sometimes more than 100 years. In the majority of cases perpetual calendar mechanisms are used to display the aforementioned data by means of a plurality of individual apertures arranged in the dial of a watch piece. This is also the case in the first embodiment of a watch described in document EP 1 351 104. This type of display only shows the calendar data for a single day and therefore does not afford the aforementioned advantage of providing a general view over an entire month. For this reason, the second embodiment of a watch described in document EP 1 351 104 proposes a calendar display device of the type mentioned at the outset by combining it with a perpetual calendar mechanism, thus adding the advantage of a general view of the calendar data over an entire month. Moreover, since it is equipped with a perpetual calendar mechanism, the device described in this document affords the advantage that the inscriptions on the scale of days are automatically readjusted at the end of each month with the inscriptions on the scale of dates.

However, the reader notices by a detailed study of this document that these two advantages are only obtained as a result of two technical features which are rather difficult to implement and, technically, are quite complex in their design. In fact, the operation of the perpetual calendar according to EP 1 351 104 is based on a program wheel carrying a retractable tooth of which the movement is controlled by rather complicated kinematics arranged on this program wheel. Moreover, the kinematic chain of the movement according to EP 1 351 104 requires two drive trains controlling, in a coordinated yet separate manner, starting from a driving wheel, the rotation of the disk of months and that of the disk of dates in relation to the fixed dial indicating the days of the week.

Document EP 1 351 105, from the same proprietor as document EP 1 351 104, describes the same device from another viewpoint and in particular relates to the problem that the calendar display devices of the type mentioned at the outset, in spite of the advantage of providing a general view of calendar data over a given month, do not make it possible until the evening of the last day of the current month to view the calendar of the following month. It is even stated in the introduction of this document that the design of a device of this type based on a mechanical watch movement would be very difficult.

Consequently, document EP 1 351 105 differs from the design of the calendar display devices of the type mentioned at the outset and suggests separating the disk of dates into two different disks each carrying approximately half the inscriptions of the dates from 1 to 31. The document further proposes turning these two disks relative to one another by rather complex kinematics already mentioned above depending on the date to be displayed, in such a way that the user can view the calendar data over a period corresponding to approximately one month, irrespective of whether it is the start or the end of the month. For example, in order to display a date at the start of the month, the first disk of dates carrying the dates from 1 to 15 is aligned with the second disk of dates carrying the dates from 16 to 31 in such a way that the numbers from 1 to 31 are arranged in ascending order, whereas in order to display a date towards the end of the month, the position of the first disk of dates carrying the dates from 1 to 15 is changed in relation to the second disk of dates carrying the dates from 16 to 31 in such a way that the numbers from 1 to 15 follow the numbers from 16 to 31, in either case the whole assembly being adapted to the dial indicating the days of the week.

This brief explanation demonstrates that the solution of documents EP 1 351 104 and EP 1 351 105, on the one hand in order to obtain an automatic adjustment of the scales of days of the week and that of the dates at the start of each month, and on the other hand in order to avoid the drawback of calendar display devices of the type mentioned at the start of this introduction of not allowing an extended view of the calendar data towards the end of the month, is rather complex in its design, is difficult to implement, is expensive to manufacture and partially even removes, owing to the fact of using two separate disks for the date, the main benefit and aesthetic attractiveness of this type of device.

Apart from the devices according to the above-mentioned documents, which however have major drawbacks as explained above, the prior art does not yet appear to include a mechanism which makes it possible, with the aid of relatively simple means, to provide the two aforementioned advantages in a calendar display device of the type mentioned at the outset, that is to say, on the one hand, an automatic indexing of the scales of days and dates at the start of each month and, on the other hand, the possibility of an extended view of the calendar data at any moment, even towards the end of the month. In view of the prior art currently known, there is thus a need to create such a device which makes it possible to provide these advantages using means which are simpler in design, easier to produce and less costly to manufacture.

SUMMARY

The object of the present invention is therefore to overcome the drawbacks of the known calendar display devices and to implement the aforementioned advantages, in particular to make it possible to produce a calendar display device allowing an automatic indexing of the scales of days and dates at the start of each month and also allowing an extended view of the calendar data at any moment, including at the end of the month, but without an excessive increase in complexity, bulk and production costs of the device, whilst retaining the main benefit and the aesthetic appearance of the mechanism.

To this end, the present invention proposes a calendar display device of the aforementioned type, in particular for a mechanical watch piece comprising a watch movement which is characterized by the features disclosed in claim 1, or a corresponding watch piece. In particular, a device according to the present invention comprises a correction mechanism cooperating with at least a gear train driving the disk of months starting from the watch movement of said watch piece, said mechanism comprising means for advancing and reversing the disk of months so as to allow modification of the month displayed on the dial in a bidirectional manner.

These means for advancing and reversing the disk of months advantageously comprise a correction star fixed to a correction wheel meshing with said gear train, and a first and second correction lever which are actuatable by push-pieces of the watch piece. Each actuation of these push-pieces thus causes a rotation of the disk of months through 1/12 of a turn either forwards or backwards, making it possible to change the month displayed on the dial in a bidirectional manner.

As a result of these measures a watch piece which allows the user to have a general view of the calendar data over the entire current month is provided, the user being free at any moment to choose the month displayed and to consult the calendar data of another month, in the manner of a diary, by pressing on the corresponding push-pieces to advance or reverse the displayed month. Compared to the mechanisms of the prior art, the device according to the present invention makes it possible to implement these advantages with the aid of simple and neat means and retains the appearance of this type of mechanism.

When said watch piece comprises only one gear train to control the disk of months and the rotary disk by the watch movement of said watch piece, a device according to the present invention further comprises a direct kinematic link between the disk of months and said rotary disk so as to make automatic the indexing between the inscription on this rotary disk and the inscriptions on the dial depending on the month displayed, that is to say so as to allow, at the same time as the aforementioned modification of the month displayed on the dial, automatic indexing between the scales of dates and days for the month newly displayed on the dial.

It is particularly advantageous to arrange the direct kinematic link between the disk of months and the rotary disk in such a way that it has two separate parts which control said automatic indexing, in short, one for the month of February, for leap years and the other for all the other months and years.

It is thus possible to control the rotary disk, whether this is the disk of dates or the disk of days, with a single gear train and directly by the disk of months, and an automatic indexing is thus obtained by means which are relatively simple in design and are easy to implement and even manufacture.

Alternatively, if said watch piece comprises two separate gear trains separately controlling the disk of months and the rotary disk by the watch movement of said watch piece, said correction mechanism is arranged so as to cooperate simultaneously with said gear train driving the disk of months and with a second gear train driving the rotary disk by the watch movement of the watch piece, in such a way that the means for advancing and reversing of said correction mechanism simultaneously control the disk of months and the rotary disk so as to make automatic the indexing between the inscriptions on said rotary disk and the inscriptions on the dial depending on the month displayed.

In a particularly interesting variation of the mechanism it is the second disk, the disk of dates, which forms the fixed dial, said first disk, the disk of days, being arranged as a ring which can turn around said dial. In a variation, the reverse arrangement is also possible. Said third disk, the disk of months, is normally arranged as a ring placed concentrically and rotatably beneath said dial. Consequently, the device may be provided in a number of embodiments and is therefore versatile in terms of technology and aesthetic appearance.

Further features and corresponding advantages will become clear from the claims as well as from the description given hereinafter describing the invention in greater detail.

BRIEF DESCRIPTION OF THE DRAWINGS

The accompanying drawings show in schematic and exemplary manner an embodiment of the invention.

DETAILED DESCRIPTION

The invention will now be described in detail with reference to the accompanying drawings illustrating by way of example an embodiment of a calendar display device according to the present invention.

Figure 1:
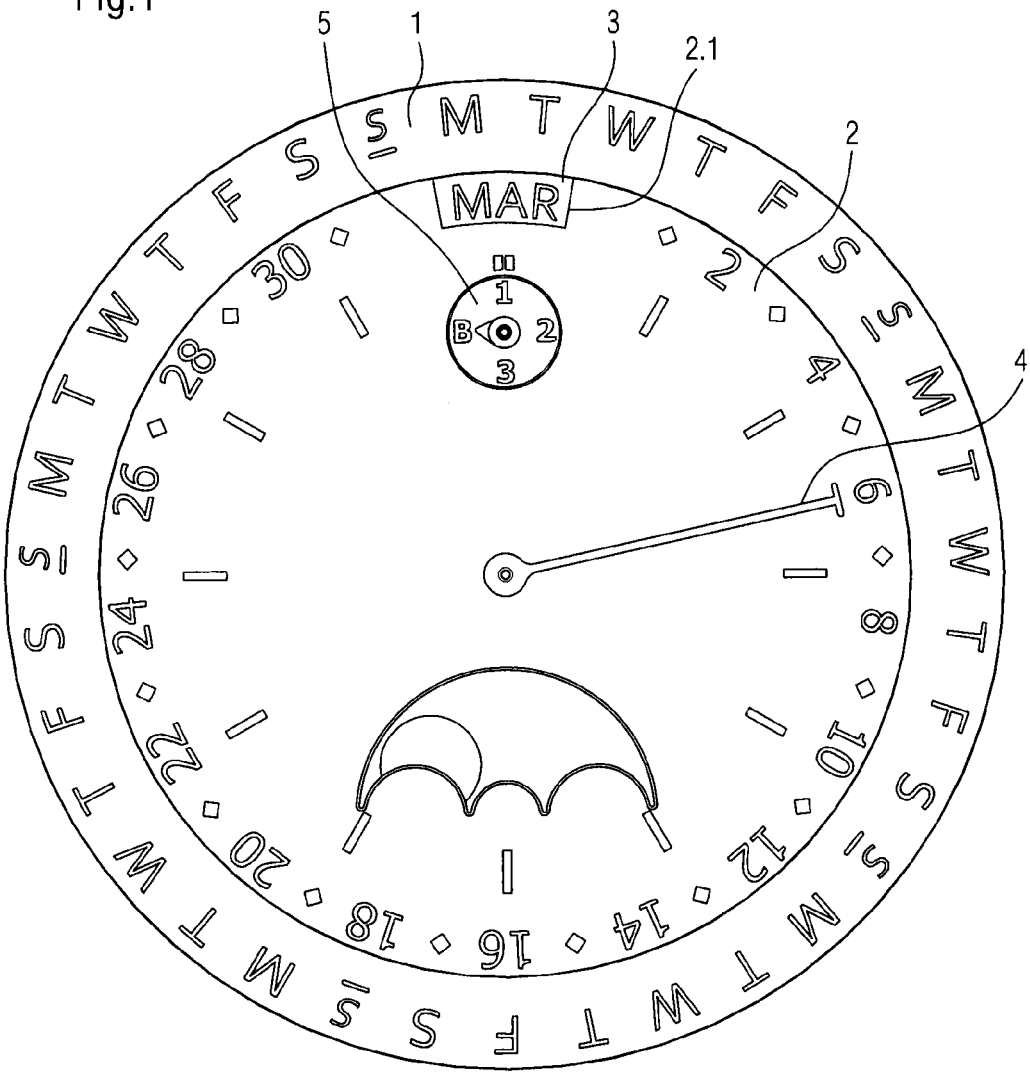
FIG. 1 is a schematic plan view of all the displays on the dial of a calendar display device according to the present invention.

As illustrated schematically in FIG. 1, a calendar display device according to the present invention is to be integrated into a mechanical watch piece comprising a conventional watch movement and belonging to the category of mechanisms which allow the user to view calendar data over an entire given month. In particular, this type of device makes it possible to match the dates of the month to the days of the week.

To this end, the device according to the invention comprises the conventional parts of a device of this type, that is to say a first disk 1, the disk of days, which carries multiple series of inscriptions symbolizing the seven days of the week, and a second disk 2, the disk of dates, which carries inscriptions symbolizing the date of the month. One of the disk of days 1 and the disk of dates 2 acts as a dial and is mounted rigidly, whereas the other of the two disks acts as a rotary disk by being arranged concentrically and rotatably in relation to said dial. FIG. 1 shows an example of a device according to the present invention, in which said second disk 2, the disk of dates, forms the fixed dial. The first disk 1, the disk of days, is arranged like a ring which can turn around the disk of dates acting as a dial. Variations of this arrangement will be discussed in detail after the detailed description of this embodiment of the device. In addition, the term 'disk' is used generically in this context, given that the corresponding parts can effectively be arranged like a disk but may also be annular. Likewise, it is obvious to the person skilled in the art that the inscriptions on the disks may take a large number of different forms without changing the scope of the present invention. For example, the dates may effectively be represented by the numbers 1 to 31 or, as shown in the figures, by a series of numbers from 1 to 31 in which the odd numbers are replaced by symbols in order to save space, or else by other symbols representative of the dates. The same applies to the disk of days, of which the symbols may consist for example of a series of initials of the days of the week where Sunday may be marked in a specific manner, as illustrated in FIG. 1, or of another series of symbols representative of the days of the week.

Furthermore, a device according to the present invention comprises a third disk 3, the disk of months, which preferably carries 12 inscriptions symbolizing the months of the year, of which the arrangement can obviously likewise be modified, similarly to the comments made above. The disk of months is mounted rotatably beneath this dial and is normally driven at a rate of 1/12 of a turn per month by the watch movement of the watch piece. The dial comprises an aperture 2.1 through which the user can see the inscription on the disk of months 3 corresponding to the month to be displayed. Likewise, and similarly to the comments made above on this topic, the disk of months 3 is preferably arranged like a ring which is placed concentrically and rotatably beneath said dial.

In the embodiment of the device illustrated in the figures, the ring or disk of days 1 carries over its periphery the series of inscriptions symbolizing the seven days of the week five times, thus 35 inscriptions, on 35 equidistant angular sectors. The disk of dates 2, that is to say in this embodiment the dial, also carries its inscriptions symbolizing the date of the month from 1 to 31 over its periphery on 31 equidistant angular sectors of the same angular dimension as the sectors on the first disk 1, as can be seen in particular in FIG. 1. The aperture 2.1 through which the user sees the inscription of the current month on the third disk 3 is arranged at the periphery of the dial 2 between the first and last inscriptions for the dates and occupies an angular dimension corresponding to four other equidistant angular sectors of the same angular dimension as the sectors on the disk of days 1. This arrangement of the dial 2 is particularly advantageous for the user in terms of the aesthetic appearance and of the clarity of the presentation of the information regarding the calendar data. However, further variations are possible and will be mentioned briefly after the detailed description of an embodiment of the calendar display device.

In order to indicate simultaneously the date and the day of the current week, a device according to the present invention also comprises a hand 4 which is placed concentrically and rotatably in relation to said dial. This hand 4 normally advances by one step per day, except for between the last day of a month and the first day of the following month, and indicates the current day and date. Given that the mechanisms for the driving and the correction of the position of this hand 4 belong to prior art, they will not be described here and are also not shown in the figures.

The embodiment of the device shown in FIG. 1 also comprises a display of current year type 5, indicating whether the year currently displayed is a leap year or a normal year. Alternatively or additionally, the device could also comprise a display of the number of the current year, for example by having a corresponding aperture. In addition, further information such as information regarding the current time by means of hour, minute and second hands, information regarding the lunar phases, etc., could of course be integrated into a corresponding watch piece, but are not shown in the figures so as not to complicate them. Their integration is in fact conventional and does not relate to the present invention.

Figure 2A:
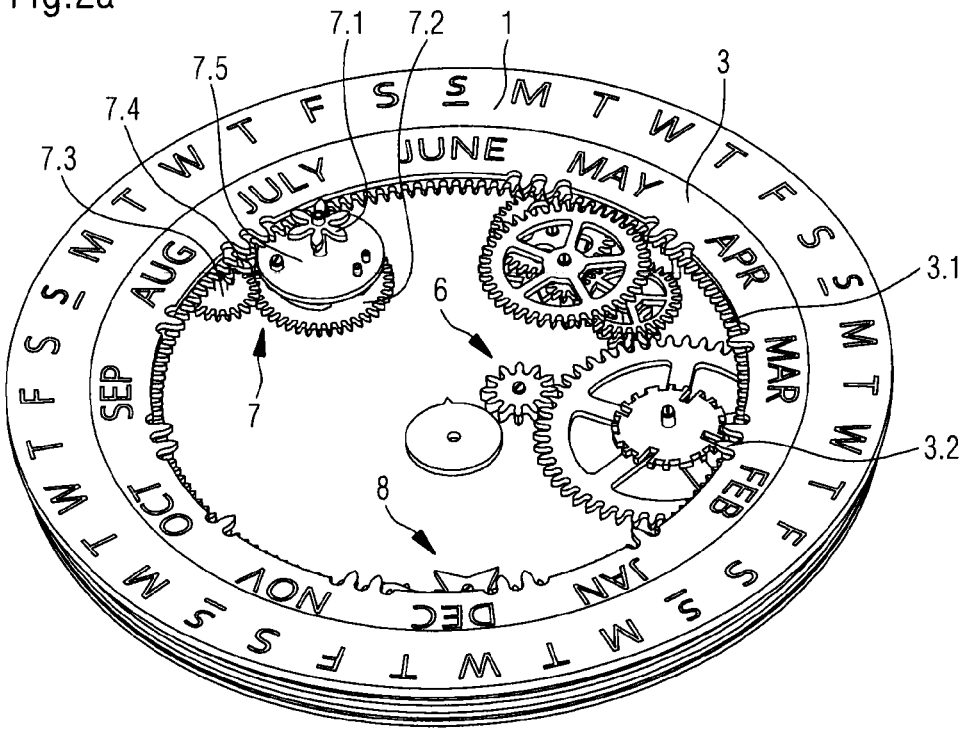
FIGS. 2*a* and 2*b* are perspective views of the device shown in FIG. 1 from two different viewpoints, the dial formed by the disk of dates being removed so as to show the parts beneath.
Figure 2B:
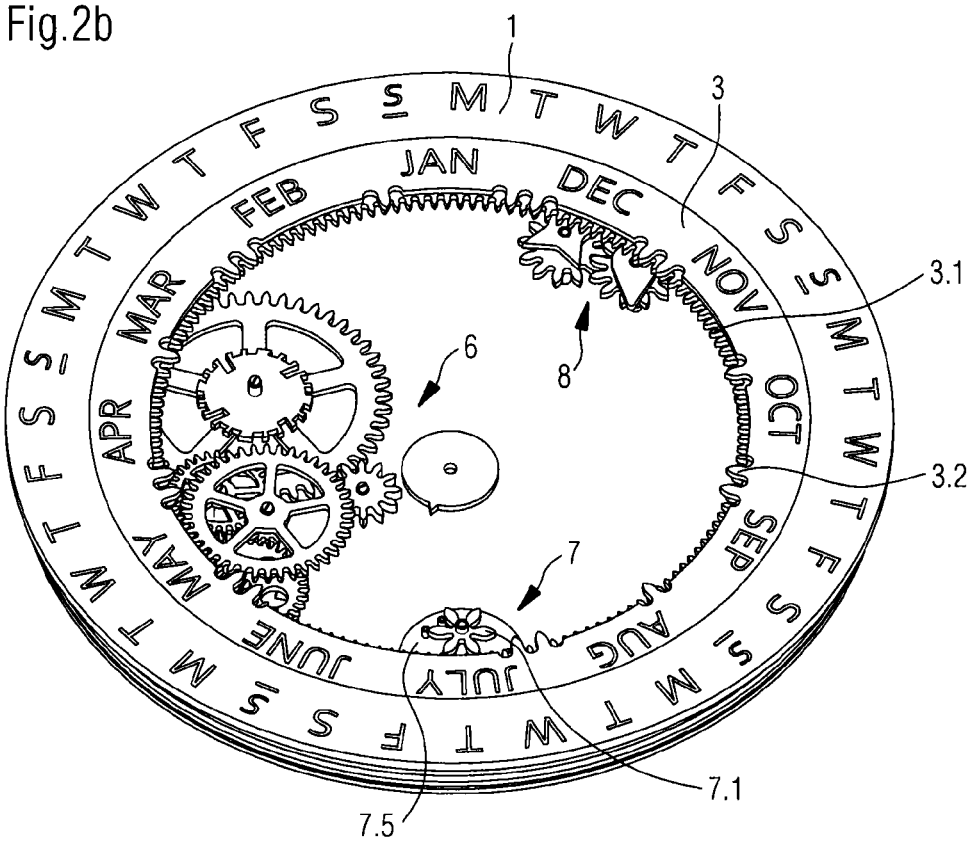

FIG. 2 is a perspective view of the device illustrated in FIG. 1, in which the dial formed by the disk of dates 2 is removed so as to show the parts arranged beneath. In this figure, the ring forming the disk of days 1 and turning around the non-illustrated dial 2 is clearly visible, as is the ring forming the disk of months 3 arranged beneath said dial. It can be seen that the disk of months 3 has two inner toothings 3.1, 3.2 on its inner circumference which are arranged on two heights of different thickness. The first inner toothing 3.1 of the disk of months 3 cooperates with a gear train 6 which makes it possible to drive this disk 3 and of which the structure and operation will be described hereinafter in greater detail with reference to FIG. 3.

Figure 3:
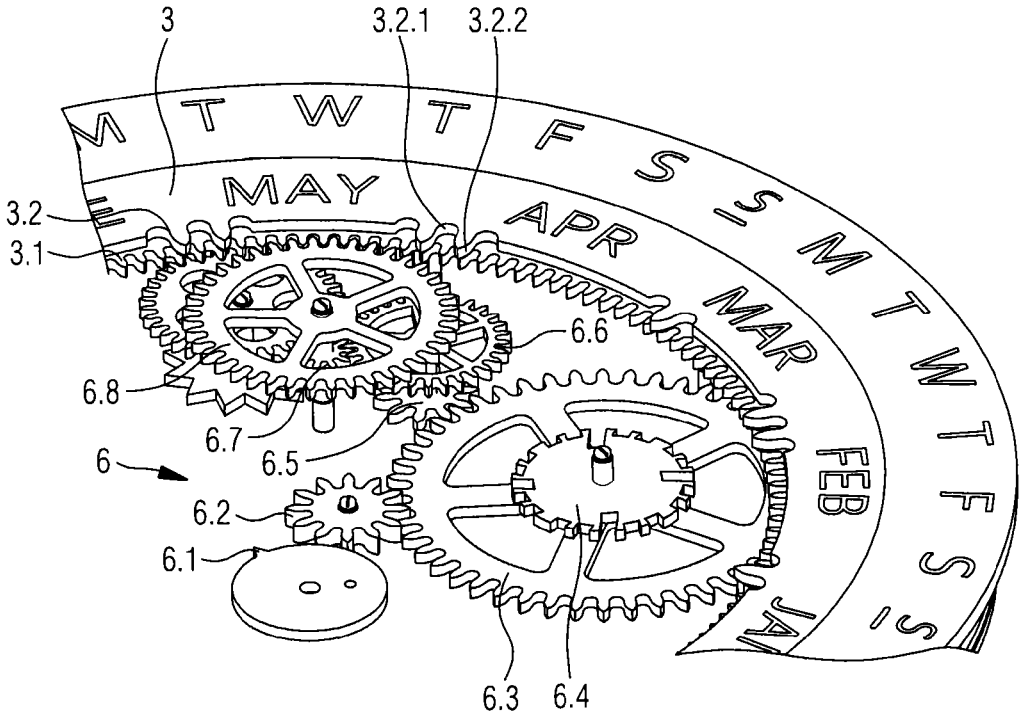
FIG. 3 is an enlarged perspective view of a part of the device shown in FIG. 2, illustrating in greater detail the gear train of the disk of months.

In fact, the disk of months 3 is driven at the desired speed by the watch movement of said watch piece by means of the gear train 6. Since the rest of the moving parts of the watch movement may be completely conventional, FIG. 3 shows merely said gear train 6 from a driving finger 6.1 which is driven by said watch movement so as to carry out, in the embodiment illustrated, one complete turn per month. This driving finger 6.1 thus drives, once a month, a first intermediate driving wheel 6.2 which meshes with a cam wheel 6.3 carrying a cam of months 6.4, of which the function will become clearer later. The cam wheel 6.3 drives a second intermediate driving wheel 6.5 fixed to a third intermediate driving wheel 6.6. The latter meshes with a driving pinion 6.7 carrying a driving wheel 6.8 which meshes with the first inner toothing 3.1 of the disk of months 3, in such a way that said disk of months rotates through 1/12 of a turn per month. The ratios of toothings of the different wheels and pinions may be selected by equipping, for example, the first intermediate driving wheel 6.2 with a toothing of 12 teeth, the cam wheel 6.3 with 48 teeth, the second 6.5 and third 6.6 intermediate driving wheels with 10 and 30 teeth respectively, and the driving pinion 6.7 and the driving wheel 6.8 with 10 and 40 teeth respectively, compared to 144 teeth on said first inner toothing 3.1 of the disk of months 3, this yielding the aforementioned result.

In addition, it should be noted that the gear train 6, respectively the components thereof, described above comprise an embodiment, but they could have any structure which makes it possible to obtain a suitable drive of the disk of months 3, the invention not actually lying in this part of the device. The aforementioned ratios could of course be selected differently, in particular if the disk of months 3 were to have 24 inscriptions instead of 12, for example, and should therefore be driven at a rate of 1/24 of a turn per month.

With reference to FIG. 2, it is noted that a device according to the present invention comprises, in contrast to the mechanisms of the prior art, a direct kinematic link 7, 8 between the disk of months 3 and the rotary disk 1, 2, in the case illustrated, the disk of days 1. This direct kinematic link 7, 8 makes it possible to render automatic the indexing between the inscriptions on said rotary disk 1, 2 and the inscriptions on the dial 2, 1, and thus the indexing between the days of the week and the dates, depending on the month displayed. As can be seen in FIG. 2, part of said direct kinematic link 7, 8 cooperates with said second inner toothing 3.2 of the disk of months 3.

In order to describe in greater detail the structure and operation of this direct kinematic link 7, 8 between the disk of months 3 and said rotary disk 1, 2, it should first be noted with regard to FIG. 2 that it comprises two separate parts 7, 8 which have separate functions which will become clearer upon reading the following explanations.

Figure 4:
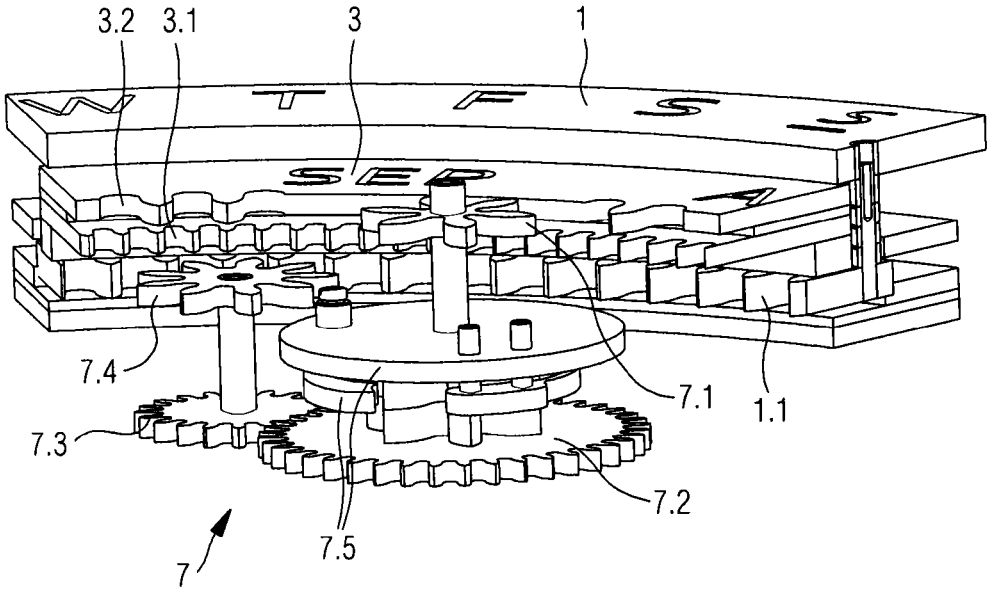
FIG. 4 is an enlarged perspective view of a part of the device shown in FIG. 2, illustrating in greater detail the first part of the direct kinematic link between the disk of months and said rotary disk.

A first part 7 of said direct kinematic link, illustrated in greater detail by an enlarged perspective view in FIG. 4, comprises a first connecting pinion 7.1 which can mesh with said second inner toothing 3.2 of the disk of months 3. Said first connecting pinion 7.1 is connected to a first intermediate connecting wheel 7.2 driving a second intermediate connecting wheel 7.3 carrying a second connecting pinion 7.4 which in turn meshes with an inner toothing 1.1 of the rotary disk 1.2 and thus, in the case illustrated in the figures, of the disk of days 1. A rotation of the disk of months 3 will thus automatically cause, except for the month of February as will become clearer from the following description, a rotation of the rotary disk 1, 2, in the example illustrated, the disk of days 1, in relation to the dial 2, 1.

As can be seen in FIG. 2, said second inner toothing 3.2 of the disk of months 3 comprises to this end 12 equidistant angular sectors each comprising, apart from the sector corresponding to the month of February, a succession of notches 3.2.1 and teeth 3.2.2 which allow the rotary disk 1, 2 to advance by the driving of the disk of months 3 in such a way that the indexing between the inscriptions on said rotary disk 1, 2 and the inscriptions on the dial 2, 1 is carried out automatically depending on the month displayed.

The operation of this first part 7 of said direct kinematic link and its cooperation with the disk of months 3 respectively with the second inner toothing 3.2 thereof will be easily comprehended if it is recalled that said mechanism carries out an automatic indexing in order to adjust the information on the rotary disk 1, 2 in relation to the information on the dial 2, 1, given that the length of the months is not generally a multiple of 7, the length of a week. As a result, it is thus necessary, when the month display is changed, to adjust the rotary disk 1, 2 by turning it in relation to the fixed dial 2, 1 so as to correctly match the days to the dates of the new month to be displayed. As can be seen from FIG. 1, it is thus possible, for the preferred embodiment illustrated in the figures, to turn the disk of days 1, once a month having 31 days has passed, through an angle corresponding to 4 equidistant angular sectors of the first disk 1, more specifically in a clockwise direction. Alternatively, it is also possible to turn the disk of days 1 in an anticlockwise direction, in this case through an angle corresponding to 3 equidistant angular sectors. Once a month having 30 days, 29 days, or 28 days has passed, this disk must therefore carry out a rotation, in the clockwise direction, corresponding to 3, 2, or 1 equidistant angular sectors respectively, or, in an anticlockwise direction, a rotation corresponding to 2, 1, or 0 sectors respectively, that is to say no rotation in the latter case, so as to allow a correct adjustment between the information of the rotary disk 1, 2 and that of the dial 2, 1.

Given that a rotation in the anticlockwise direction requires a shorter path to be performed by the rotary disk 1 and thus presents a more favourable performance in terms of energy consumption than a rotation in the clockwise direction, the first solution of an adjustment by anticlockwise rotation is illustrated in the figures. However, it is possible for the person skilled in the art, in view of the technical teaching of the present description, to also implement the second solution of an adjustment by clockwise rotation. In order to implement the first solution of an anticlockwise rotation of the rotary disk 1, 2 during the readjustment, the 12 equidistant angular sectors of said second inner toothing 3.2 of the disk of months 3 are arranged in such a way as to effect, by means of the moving parts described above of the first part 7 of the direct kinematic link, a rotation of 3, 2, 1 or 0 steps of the rotary disk 1, 2 at the end of a month having 31, 30, 29 or 28 days respectively, one step corresponding to an angular distance of one of said equidistant angular sectors of the first disk 1. Given that only the month of February in a leap year has 29 days and that no adjustment is necessary for the months of February in a normal year having 28 days, the 12 equidistant angular sectors of said second inner toothing 3.2 of the disk of months 3 each have, except for the sector corresponding to the month of February, a succession of notches 3.2.1 and teeth 3.2.2 which are able to allow the rotary disk 1, 2 to advance, following the driving of the disk of months 3 by the gear train 6 and by means of the first part 7 of the direct kinematic link described above, through a corresponding number of steps. A sector of said second inner toothing 3.2 of the disk of months 3 corresponding to a month having 31 days thus comprises three notches 3.2.1 and two teeth 3.2.2, a sector of said second inner toothing 3.2 of the disk of months 3 corresponding to a month having 30 days comprises two notches 3.2.1 and 1 tooth 3.2.2, and the sector of said second inner toothing 3.2 of the disk of months 3 corresponding to the month of February has no notches or teeth. It remains to be noted that, depending on the arrangement of the first part 7 of the direct kinematic link over the inner periphery of the disk of months 3, the 12 equidistant angular sectors of said second inner toothing 3.2 of the disk of months 3 are not necessarily aligned with the corresponding inscriptions on the upper surface of the disk of months 3, as is also the case in FIG. 2.

In order to ensure a desired driving of the rotary disk 1, 2 corresponding to the arrangement described above of the second toothing 3.2 of the disk of months 3, the first connecting pinion 7.1 and the second connecting pinion 7.4 of the first part 7 of the direct kinematic link may, for example, have 6 and 9 teeth respectively, whereas said first intermediate connecting wheel 7.2 and said second intermediate connecting wheel 7.3 have a toothing of 20 and 10 teeth respectively, the inner toothing 1.1 of the rotary disk having 105 teeth, corresponding to 3 teeth on each of its 35 equidistant angular sectors illustrated in FIG. 2. It is clear to the person skilled in the art that these toothings and the corresponding reduction ratios can be modified as far as the rotary disk 1, 2 is driven as described above.

The explanations above demonstrate that a rotation of the disk of months 3 caused by the watch movement of the watch piece at the end of each month will automatically cause, except for the month of February, a rotation of the rotary disk 1, 2, in the example illustrated the disk of days 1, in relation to the dial 2, 1 in such a way that the inscriptions on the rotary disk 1, 2 are again adjusted correctly in relation to the inscriptions on the dial 2, 1.

With regard to said first part 7 of the direct kinematic link, it remains to be noted that it also comprises decoupling means 7.5, preferably a catch release mechanism. For example, these decoupling means 7.5 are placed between the first connecting pinion 7.1 and the first intermediate connecting wheel 7.2, as can be seen in FIG. 4, and make it possible to drive the rotary disk 1, 2 independently of said first part 7 of the direct kinematic link. In particular, they allow a rotation of the rotary disk 1, 2 independently of a rotation of the first connecting pinion 7.1, of which the teeth lock rotation thereof when they slide over the equidistant angular sector on the second toothing 3.2 of the disk of months 3 corresponding to the month of February, given that this sector is smooth. The function of these decoupling means 7.5 will become clearer in the description below.

Figure 5:
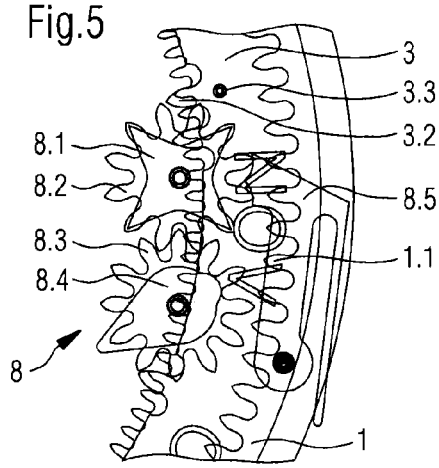
FIG. 5 is an enlarged plan view of a part of the device shown in FIG. 2, illustrating in greater detail the second part of the direct kinematic link between the disk of months and said rotary disk.

With reference to FIG. 5, focus will now be placed on the description of the second part 8 of the direct kinematic link, said second part also being shown in FIG. 2. Said second part 8 of said direct kinematic link comprises a four-tooth star 8.1 able to cooperate with a pin 3.3 fixed on the disk of months 3. The star 8.1 is fixed to a first intermediate wheel 8.2 meshing with a second intermediate wheel 8.3 which is fixed to an actuating finger 8.4. Said actuating finger is able to mesh with the inner toothing 1.1 of the rotary disk 1, 2 in such a way that, upon every fourth actuation of the star 8.1 by the disk of months 3, said rotary disk 1, 2 is advanced through one step. As can be seen from the enlarged plan view in FIG. 5, the first and second intermediate wheels 8.2, 8.3 may, to this end, each have 12 teeth. Further options are of course available to the person skilled in the art, but the number of teeth on these pinions 8.2, 8.3 and on the star 8.1 must be a multiple of 4 so that the four-tooth star 8.1 and the actuation finger 8.4 carry out a quarter of a turn upon each actuation.

Figure 6A:
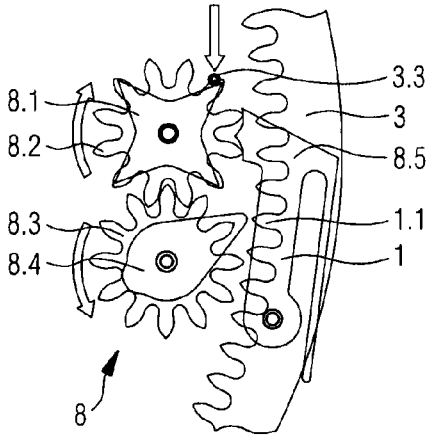
FIGS. 6*a* and 6*b* are schematic plan views, illustrating the operation of the second part of said direct kinematic link during a normal year.
Figure 6B:
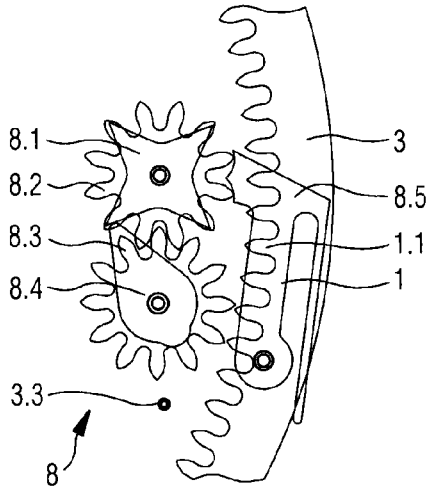

The operation of said second part 8 of the direct kinematic link is easily understood with the aid of FIGS. 6*a* and 6*b* respectively 7*a* and 7*b*, which show the operating steps of the second part of the device during a normal year and during a leap year respectively by schematic plan views. In fact, the description above has demonstrated that the automatic indexing between the rotary disk 1, 2 and the dial 2, 1 is carried out by the first part 7 of the direct kinematic link with regard to the months having 31 or 30 days and is not necessary, at least with regard to the preferred solution of an adjustment by rotation in the anticlockwise direction, for the month of February in a normal year, the length of this month being a multiple of 7, i.e. the number of days of the week. During normal operation of the device or watch piece equipped therewith, the second part 8 of the direct kinematic link only effectively comes into action at the end of the month of February of a leap year—the only case of a month having 29 days and requiring an adjustment of the rotary disk 1, 2 through one step, as explained above.

The pin 3.3 fixed on the disk of months 3 advances each month, when the disk of months 3 is driven by the gear train 6, through an angular distance corresponding to one of the 12 equidistant angular sectors on the disk of months 3. During a normal year and as illustrated schematically in FIGS. 6*a* and 6*b*, this pin 3.3 is, at the end of the month of February, close to the second part 8 of the direct kinematic link. At this moment, when the disk of months 3 is driven so as to move the display from the month of February to the month of March, the pin 3.3 advances along the path indicated by an arrow in FIG. 6*a* and cooperates with a tooth of the four-tooth star 8.1, causing it to rotate through a quarter of a turn in the direction of the arrow indicated in FIG. 6*a*. By means of the first and second intermediate wheels 8.2, 8.3, this causes a rotation of the actuating finger 8.4 through a quarter of a turn, in the direction of the arrow indicated in FIG. 6*a*, upon each actuation of the four-tooth star 8.1, that is to say once per year during the normal operation of the device respectively of the watch piece equipped therewith. FIG. 6*b* shows the position of the parts after the rotation through a quarter of a turn during the first year of operation. As can be seen clearly in FIGS. 6*a* and 6*b*, the actuating finger 8.4 turns freely during the first, second and third years of operation, thus resulting in no modification to the position of the rotary disk 1, 2, given that for these years the month has 28 days, thus requiring no adjustment.

Figure 7A:
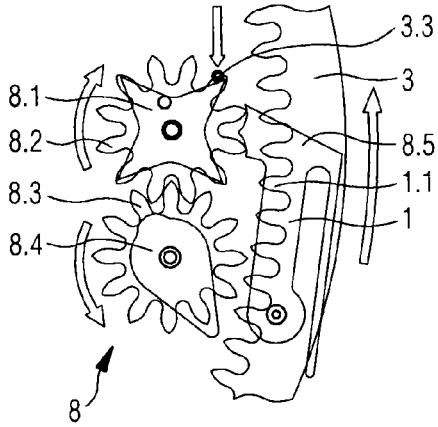
FIGS. 7*a* and 7*b* are schematic plan views, illustrating the operation of the second part of said direct kinematic link during a leap year.
Figure 7B:
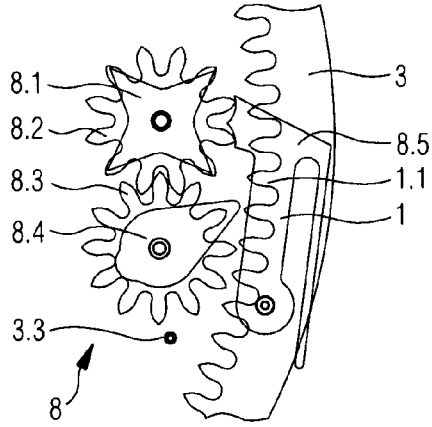

After having rotated through three quarters of a turn during the first three normal years of operation, the parts are in a position as shown in FIG. 7*a*. When the disk of months 3 is driven by the gear train 6 during the fourth year, thus a leap year, so as to move the display from the month of February to the month of March, the pin 3.3 again cooperates with a tooth of the four-tooth star 8.1 and causes a rotation thereof through a quarter of a turn in such a way that the driving finger 8.4 again rotates through a quarter of a turn and completes its rotation of one complete turn in four years. Not turning freely this time, the driving finger 8.4 meshes with the toothing 1.1 of the rotary disk 1 and drives said rotary disk through three teeth in the example of the toothings described above, that is to say through an angular distance corresponding to 1 step or specifically to one of the 35 equidistant angular sectors of the rotary disk 1, 2. This adjustment is possible independently of the first part 7 of the direct kinematic link owing to the decoupling means 7.5 mentioned above. In particular, these means make it possible to disconnect the rotation of the rotary disk 1, 2 at the end of the month of February in a leap year from the pinion 7.1, which remains immobile in this case since it is locked by the sliding of its teeth over the smooth sector of the disk of months 3.

The inscriptions on the rotary disk 1, 2 and the inscriptions on the dial 2, 1 are thus also indexed automatically for the month of February in a leap year. It is thus to be noted here that the device described above, respectively a watch piece equipped with a device according to the present invention, makes it possible to provide the user with a completely automatic indexing between the inscriptions on said rotary disk 1, 2 and the inscriptions on the dial 2, 1 depending on the month displayed. Owing to the two parts 7, 8 of the direct kinematic link, this is the case for normal years and for leap years, the device thus effectively forming a perpetual calendar mechanism. Moreover, these advantages are achieved with the aid of mechanical means which are relatively simple in design and easy to produce, in particular using merely a single gear train between the movement of the watch piece and the disk of months 3, the rotary disk 1, 2 then being controlled simply by the disk of months.

It remains to be noted with regard to the second part 8 of the direct kinematic link that at least one of said intermediate wheels 8.2, 8.3 comprises a toothing 8.2.1 able to cooperate with a jumper 8.5. Said jumper holds the four-tooth star 8.1 in its rest position, which is important during the operation described above in order to avoid an involuntary rotation of the rotary disk 1, 2. Moreover, said at least one of said intermediate wheels 8.2, 8.3 is arranged so that the jumper 8.5 repositions said intermediate wheel 8.2, 8.3 with which it cooperates, after actuation of the star 8.1 by said pin 3.3 fixed on the disk of months 3, in such a position that the teeth 8.1.1, 8.1.2 of the four-tooth star 8.1 oriented towards the disk of months 3 are always located in the path of said pin 3.3, irrespectively of the direction of rotation of the disk of months.

Figure 8A:
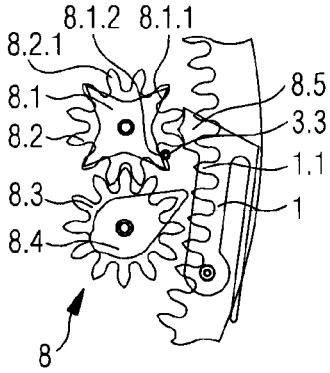
FIGS. 8*a*, 8*b* and 8*c* are schematic plan views, illustrating in greater detail the operation of the second part of said direct kinematic link with respect to its cooperation between the pin of the disk of months and the four-tooth star, respectively; the corresponding jumper of said kinematic link, and some parts being illustrated transparently so as to facilitate comprehension.
Figure 8B:
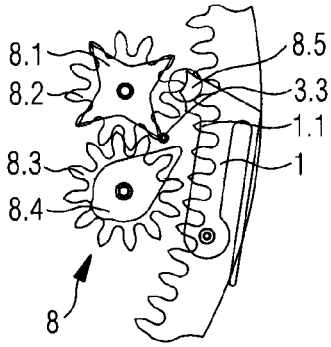
Figure 8C:
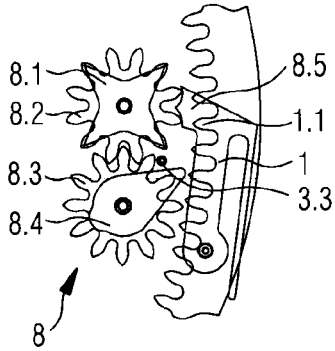
Figure 9:
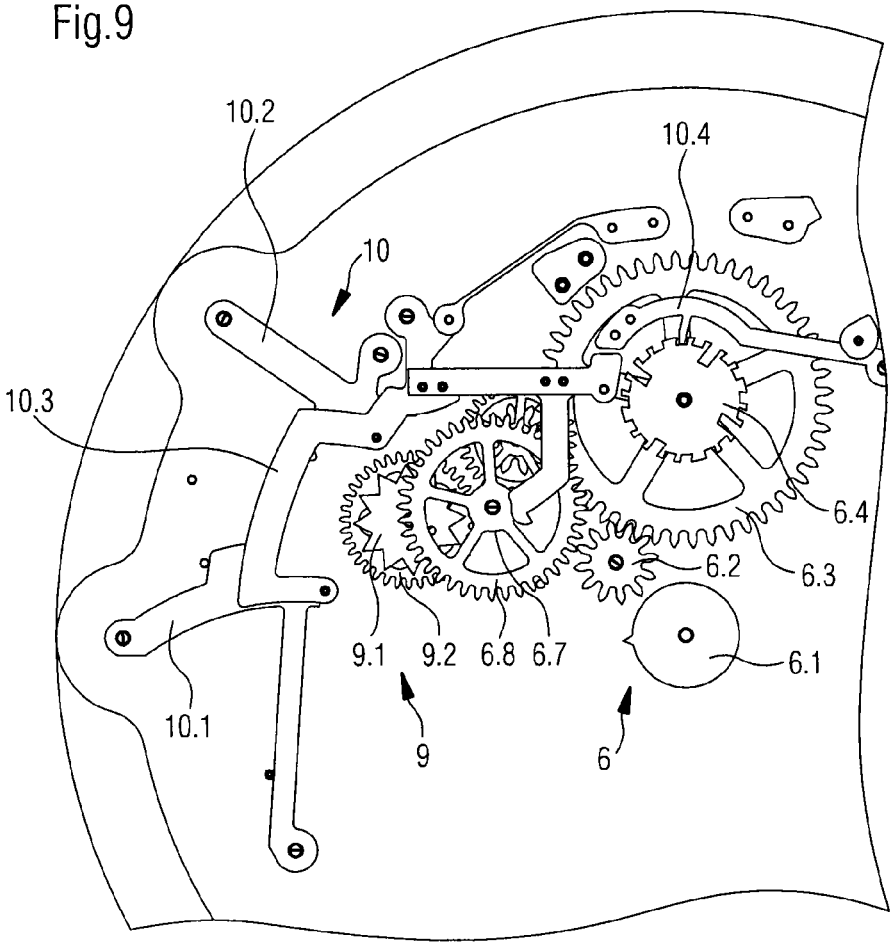
FIG. 9 is an enlarged schematic plan view of a part of the correction mechanism, illustrating in greater detail the first and second correction levers.

This is achieved owing to the fact that the teeth of said at least one intermediate wheel 8.2, 8.3 and the point of said jumper 8.5 are arranged in such a way that, after actuation of the four-tooth star 8.1 by the pin 3.3, that is to say after a rotation through a quarter of a turn of the star 8.1, the jumper 8.5 does not jump the point of the last tooth of the corresponding intermediate wheel, but repositions said intermediate wheel respectively the four-tooth star 8.1 backwards over a small angular distance. The jumper 8.5 thus resets the four-tooth star 8.1 in a rest position in which the pin 3.3 will actuate, in any case, one of the teeth of the star 8.1, irrespectively of whether the pin 3.3 respectively the disk of months 3 turns in a clockwise or anticlockwise direction. The different phases of this cooperation between the toothing 8.2.1 of the corresponding intermediate wheel 8.2, 8.3 and the jumper 8.5 are illustrated schematically in FIGS. 8*a* to 8*c*. In FIG. 8*a* the pin 3.3 has driven the four-tooth star 8.1 through a quarter of a turn, but it is not yet disengaged from the last tooth of the star 8.1 which is on its path, given that the disk of months 3 has not yet moved a complete step. In FIG. 8*b* the pin 3.3 is disengaging from said last tooth, the disk of months 3 continuing its rotation. The encircled part of FIG. 8*b* shows that the point of the jumper 8.5 does not move to the other side of the tooth on which the jumper 8.5 is engaged during this phase of the movement. Lastly, in FIG. 8*c*, the rest position into which the jumper 8.5 resets the four-tooth star 8.1 in cooperation with the tooth on which it was resting in FIG. 8*b* can be seen, the directions of movement of FIGS. 8*a* to 8*c* being indicated by arrows. This rest position corresponds to the position which can be seen in FIG. 8*a*. In this position the teeth 8.1.1, 8.1.2 of the four-tooth star 8.1 oriented towards the disk of months 3 are always arranged in the path of said pin 3.3, irrespectively of the direction of rotation of the disk of months. The purpose of this feature will become clearer from the description below.

In fact, a calendar display device according to the present invention may also comprise a correction mechanism 9, 10, of which the structure and operation will be described hereinafter with reference to FIGS. 9, 10*a* to 10*d*, and 11 a to 11*d*.

In an embodiment, this correction mechanism 9, 10 cooperates with said gear train 6 driving the disk of months 3 starting from the watch movement of said watch piece. In particular, said mechanism 9, 10 comprises means for advancing and reversing the disk of months 3 so as to change, in a bidirectional manner, the month displayed on the dial 2, 1. As shown schematically in FIG. 9, said means for advancing and reversing the disk of months 3 comprise, on the one hand, a correction star 9.1 fixed to a correction wheel 9.2 meshing with said gear train 6 driving the disk of months 3. For example, the correction star 9.1 may have 12 teeth and the correction wheel 9.2 may have a toothing of 36 teeth which meshes with the driving pinion 6.7 mentioned in the description of the gear train 6. Of course, the person skilled in the art could choose another arrangement of these moving parts and/or another reduction ratio depending on the arrangement of the participating wheels. On the other hand, these means for advancing and reversing the disk of months 3 comprise a first 10.1 and a second 10.2 correction lever which are actuatable by pressure and, when actuated, cause a rotation of the correction star 9.1 in an anticlockwise or clockwise direction, thus driving the disk of months 3 through 1/12 of a turn either forwards or backwards respectively upon each actuation of one of said levers 10.1, 10.2. In particular, the actuation of the first 10.1 and of the second 10.2 correction levers causes, by means of an intermediate control 10.3, the lifting of a main control 10.4 cooperating with said cam of months 6.4 arranged on the cam wheel 6.4 in the gear train 6 driving the disk of months 3. The train of said gear train 6 is thus released during the correction of the displayed month whereas the gear train 6 and the disk of months 3 are secured by a corresponding jumper not shown in the figures when none of the levers 10.1, 10.2 is actuated. By actuating one of said levers 10.1, 10.2, the user can therefore modify, in a bidirectional manner, the month displayed on the dial 2.1 so as to consult, in the manner of a diary, the calendar data for the month which he wishes to display.

Figure 10A:
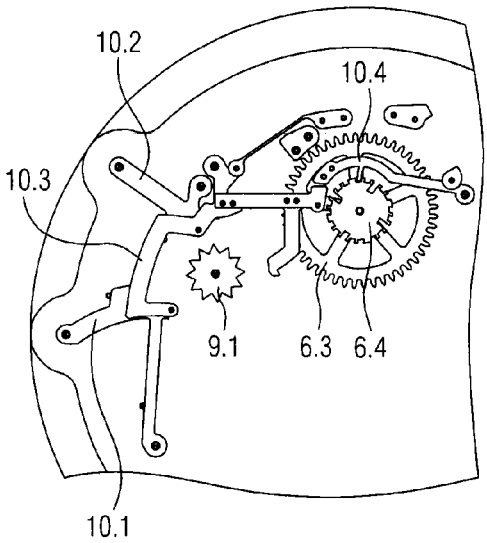
FIGS. 10*a*, 10*b*, 10*c* and 10*d* are schematic plan views, illustrating in greater detail the different phases of operation of the correction mechanism during an operation of advancing by one month.
Figure 10B:
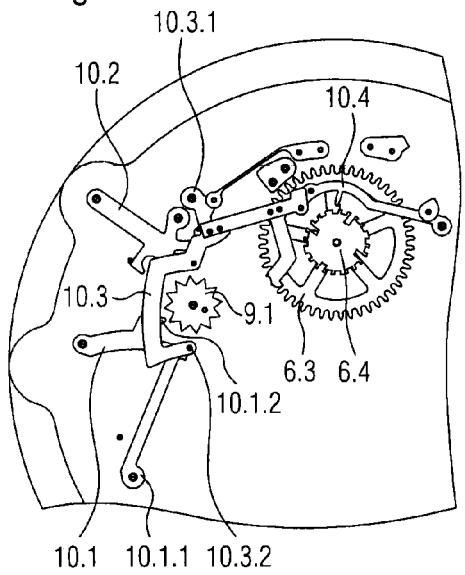
Figure 10C:
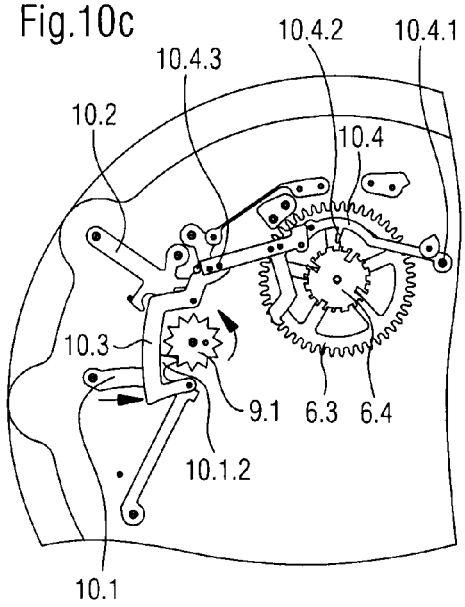
Figure 10D:
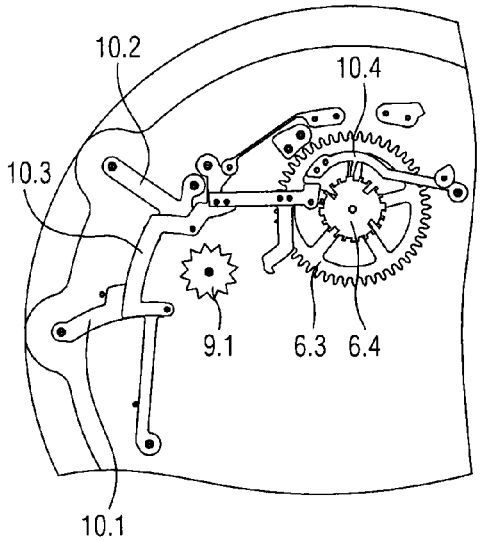

The sequence of FIGS. 10*a*, 10*b*, 10*c* and 10*d* shows schematic plan views illustrating in greater detail the different phases of operation of the correction mechanism 9, 10 during an operation of advancing by one month. FIG. 10*a* shows the rest position or the starting position of the parts forming part of the correction mechanism 9, 10. FIG. 10*b* is a schematic view showing the position of the parts when the user starts to press on the correction lever 10.1, causing it to pivot about its axis 10.1.1 and causing its free end 10.1.2 to move. Said free end pushes the intermediate control 10.3, for example, with the aid of a first pin 10.3.2 fixed to said intermediate control 10.3 so as to pivot said intermediate control about the axis 10.3.1 thereof. For example, with the aid of another pin 10.4.3 fixed to the main control 10.4, this pivoting causes the lifting of said main control 10.4 which pivots about the axis 10.4.1 thereof and is normally biased against the cam of months 6.4. In fact, this control 10.4 forms part of the perpetual calendar mechanism further comprising a month-end cam, a pawl, said main control 10.4 and the cam of months 6.4, this mechanism not being described here in greater detail given that it is not the subject of the present invention and is known as such to the person skilled in the art. The main control 10.4 cooperates with the cam of months 6.4 arranged on the cam wheel 6.3 in the gear train 6 driving the disk of months 3 so as to control, depending on the depth of the notches in the cam of months 6.4, the length of the months in the manner known within the art. Said lifting of said main control 10.4 causes the release of the cam of months 6.4, the finger 10.4.2 of the main control 10.4 exiting from one of the notches in the cam of months 6.4, as can be seen in FIG. 10*b*. FIG. 10*c* then shows, once the gear train 6 is released and the user continues to press on the first correction lever 10.1, that the free end 10.1.2 of the first lever 10.1 continues to advance until it meshes with the toothing of the correction star 9.1 so as to turn the latter, at the end of its course, through 1/12 of a turn in the anticlockwise direction, indicated symbolically by an arrow in FIG. 10*c*. This actuation of the correction star 9.1 causes, by means of the correction wheel 9.2 and the gear train 6 visible in FIG. 9, an advance through 1/12 of a turn by the disk of months 3, and thus a change to the display of the month as well as, by means of the direct kinematic link 7, 8, an automatic adjustment between the inscriptions on the rotary disk 1, 2 and those on the dial 2, 1, and thus an automatic adjustment between the day and the date displayed in such a way that they correspond to the month currently displayed. FIG. 10*d* lastly shows the position of the different parts once the user no longer presses on the first correction lever 10.1, the correction mechanism having found its starting position illustrated in FIG. 10*a*.

Figure 11A:
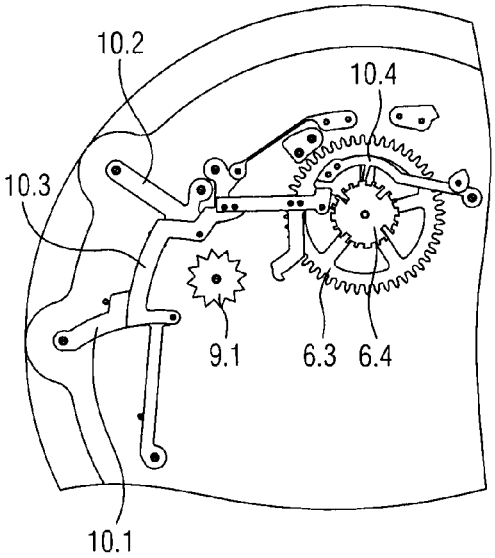
FIGS. 11*a*, 11*b*, 11*c* and 11*d* are schematic plan views, illustrating in greater detail the different phases of operation of the correction mechanism during an operation of reversing by one month.
Figure 11B:
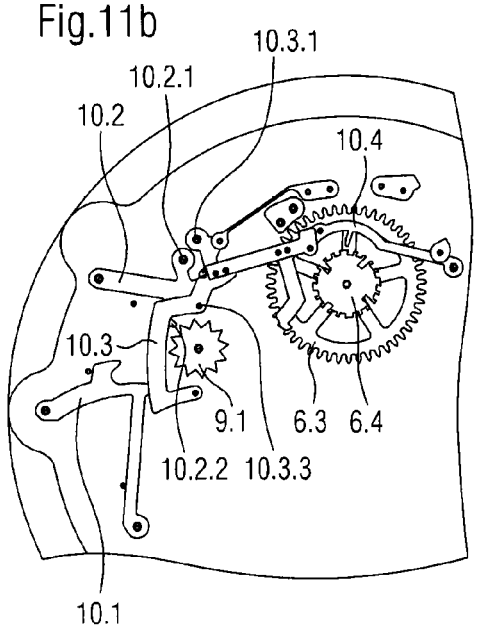
Figure 11C:
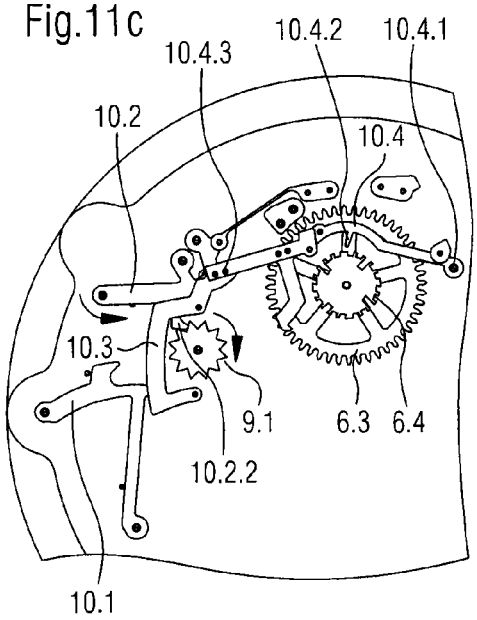
Figure 11D:
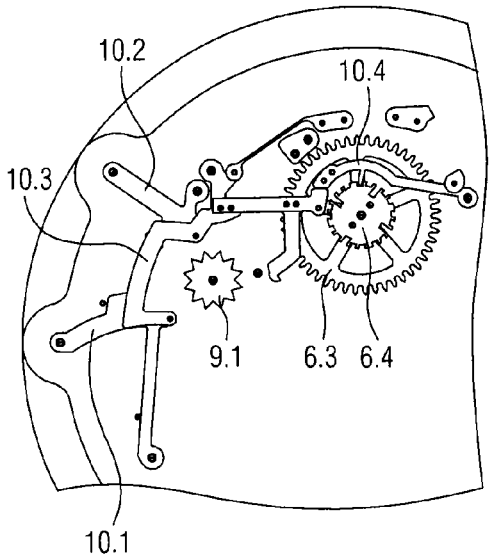

Similarly, the sequence of FIGS. 11*a*, 11*b*, 11*c* and 11*d* shows schematic plan views illustrating in greater detail the different phases of operation of the correction mechanism 9, 10 during an operation of reversing by one month. Again, FIG. 11 a shows the rest position or the starting position of the parts forming part of the correction mechanism 9, 10. FIG. 11*b* is a schematic view showing the position of the parts when the user starts to press on the second correction lever 10.2, causing it to pivot about its axis 10.2.1 and causing its free end 10.2.2 to move. Said free end pushes the intermediate control 10.3, for example, with the aid of a second pin 10.3.3 fixed to said intermediate control 10.3 so as to pivot said intermediate control about the axis 10.3.1 thereof. Again, with the aid of the pin 10.4.3 fixed to the main control 10.4, this pivoting causes the lifting of said main control 10.4 by causing it to pivot about the axis 10.4.1 thereof. As in the case of an advance by one month, the lifting of said main control 10.4 causes the release of the cam of months 6.4 owing to the fact the finger 10.4.2 of the main control 10.4 exits from one of the notches in the cam of months 6.4. FIG. 11*c* then shows, once the gear train 6 is released and the user continues to press on the second correction lever 10.2, that the free end 10.2.2 of said lever 10.2 continues to advance until it meshes with the toothing of the correction star 9.1 so as to make it turn, at the end of its course, through 1/12 of a turn, this time in the clockwise direction. Again, the directions of movement are indicated symbolically by arrows in FIG. 11*c*. This actuation of the correction star 9.1 causes, by means of the correction wheel 9.2 and the gear train 6 visible in FIG. 9, a reverse through 1/12 of a turn by the disk of months 3, and thus a change to the display of the month as well as, by means of the direct kinematic link 7, 8, an automatic adjustment between the inscriptions on the rotary disk 1, 2 and those on the dial 2, 1, and thus an automatic adjustment between the day and the date displayed in such a way that they correspond to the month currently displayed. FIG. 11*d* lastly shows the position of the different parts once the user no longer presses on the second correction lever 10.2, the correction mechanism having found its starting position illustrated in FIG. 11*a*.

It remains to be added that the different parts such as the levers 10.1, 10.2 and controls 10.3, 10.4 are of course biased, for example, with the aid of corresponding springs, towards their rest positions, these biasing means not being illustrated in the figures for the sake of simplicity. Likewise, it should be noted that the main control 10.4 is, of course, also raised, by means not illustrated, of the cam of months 6.4 during normal operation of the device, that is to say when the disk of months 3 is advanced through one step by the movement of the watch piece instead of being corrected manually by the user with the aid of correction levers.

Lastly, it should be noted within the context of the correction mechanism 9, 10 that the solution described above relates to the case in which the watch piece comprises merely a single gear train 6 for controlling the disk of months 3 and the rotary disk 1, 2 by the watch movement of said watch piece, that is to say if the device comprises a direct kinematic link 7, 8 between the disk of months 3 and said rotary disk 1, 2. Without it being necessary to describe this variation in detail, it will be clear to the person skilled in the art equipped with the technical teaching of the present invention that said gear train 6, in order to control the disk of months 3 and the rotary disk 1, 2 by the watch movement of said watch piece, could also be arranged in such a way as to first drive the rotary disk, said direct kinematic link 7, 8 then driving the disk of months 3 by said rotary disk. This thus represents the reverse arrangement of the embodiment discussed in detail above. In this case, the gear train 6 and the correction mechanism 9, 10 described above must be adapted according to the explanations given above, which is within the scope of the person skilled in that art equipped with the present technical teaching. In particular, the correction mechanism 9, 10 could, for example, in this case only act indirectly, by means of the kinematic link 7, 8, on the disk of months 3, instead of driving it directly with the aid of the gear train 6, as in the case described in detail above.

Likewise, it is in principle also conceivable to replace such a single gear train 6 of the disk of months 3 and of the rotary disk 1, 2 in combination with the direct kinematic link 7, 8 with two separate gear trains separately controlling the disk of months 3 and the rotary disk 1, 2 starting from the watch movement of said watch piece. In this case, the correction mechanism 9, 10 described above must be adapted similarly to the explanations given and will be arranged so as to cooperate simultaneously with said gear train 6 driving the disk of months 3 and with a second gear train driving the rotary disk 1, 2 by the watch movement of the watch piece. In this way, the means for advancing and reversing said mechanism 9, 10 simultaneously control the disk of months 3 and the rotary disk 1, 2 by means of the gear train 6 driving the disk of months 3 and the second gear train driving the rotary disk 1, 2 so as to make automatic the indexing between the inscriptions on said rotary disk 1, 2 and the inscriptions on the dial 2, 1 depending on the month displayed, similarly to the preferred solution described in detail above. For example, the second gear train driving the rotary disk 1, 2 can be arranged as is known in the art, whilst the cooperation between said second gear train and the means for advancing and reversing said mechanism 9, 10 can similarly be supplemented by means corresponding to the ones used for the gear train 6 driving the disk of months 3. Without it being necessary to describe such a variation of the correction mechanism in detail, the person skilled in the art equipped with the present technical teaching will therefore know how to adapt the mechanism described in detail above within the scope of the preferred solution to the case of an alternative solution requiring a separate connection of said correction levers 10.1, 10.2 to two separate gear trains described above. For this reason, the alternative solution of using two separate gear trains clearly remains a feasible option.

It remains to be noted that, of course, other equivalent embodiments, not illustrated in the figures, of a calendar display device according to the present invention can be envisaged. For example, it is possible to vary the position or arrangement of the rotary disk 1, 2, without the overall operation or the result in terms of display differing substantially in relation to what has been disclosed above. All these embodiments are in fact within the scope of the person skilled in the art equipped with the technical teaching according to the present description, without it being possible to describe them all here in detail.

In order to explicitly cite some examples in this instance, it would also be possible to arrange the fixed dial, which still indicates the dates, as a ring, whereas the rotary disk indicating the days would be arranged as an actual disk which turns in this case inside said ring. This arrangement represents the reverse, in a certain way, of the arrangement according to the embodiment described in detail above. A further variation modifying the arrangement illustrated in FIG. 1 consists in reversing the rotary disk and the dial from another aspect, that is to say to use the disk of days 1 as a fixed dial and the disk of dates 2 as a rotary disk. Similarly to the two cases mentioned above, this arrangement may in principle be provided in the form of two different variations. On the one hand, said first disk 1, the disk of days, may form the fixed dial, whereas said second disk 2, the disk of dates, is arranged as a ring which can turn around said dial, said third disk 3, the disk of months, being arranged as a ring arranged concentrically and rotatably beneath said dial. On the other hand, the disk of days 1, whilst forming the fixed dial, may also be arranged as a ring, the disk of dates 2 forming the rotary disk turning inside in this case. In these two latter cases, the aperture 2.1 is integrated in the disk of days 1. The disk of dates 2 still requiring 31 sectors, it is thus preferable to equip the disk of days 1 with four times the series of inscriptions symbolizing the seven days of the week over 28 equidistant angular sectors, whereas said aperture occupies three equidistant angular sectors of the same size. In this way, by correspondingly modifying the gear train and the toothing of the different parts which mesh together, it is possible to obtain an equivalent result with regard to the display compared to the other embodiment. Further variations having for example six times the series of inscriptions symbolizing the seven days of the week on 42 equidistant angular sectors or modifying other features in this regard are also conceivable and lie within the scope of the person skilled in the art in view of the present technical teaching.

A further modification which also applies to the four arrangements mentioned above consists in placing the third disk 3, the disk of months, beneath the dial in a manner which is not concentric. In fact, although it is possible to place the disk of months 3 concentrically in relation to the disks of days 1 and dates 2, this is not necessary. Likewise, it is not necessary for the disk of months 3 to be arranged as a ring—it may also be formed by a solid disk. Also, in both cases, the gear train 6 could cooperate with the disk of months 3 with the aid of an outer toothing or a disk axis instead of an inner toothing.

In addition, it remains to be noted that the present invention also relates to a watch piece which comprises a calendar display device according to the present invention and as described above, said device being driven by the basic movement of the watch piece. In particular, said first 10.1 and second 10.2 correction levers of the device are normally actuatable by means of corresponding first and second push-pieces arranged on the case of the watch piece.

In view of the description above, it is clear that a calendar display device comprising the above-mentioned features according to the present invention affords the significant advantage of offering, in addition to an overall view of the calendar data for an entire month, the option of manually changing the month displayed, in the manner of a diary, thus affording the user the opportunity to consult at any moment the calendar data of the month which he wishes. Moreover, such a device normally also enables an automatic indexing between the information regarding the days of the week and the dates when the month display is changed. This automatic indexing applies to normal years and also to leap years, making the device perpetual. Also, this automatic indexing may be carried out by a number of means, in particular by a direct kinematic link between the disk of months and the rotary disk, and thus in a particularly neat manner in terms of technology. In addition, the device is highly versatile owing to the fact that it can be provided in a number of variations depending on technical or aesthetic requirements. These advantages are obtained without an excessive increase in complexity, bulk or production costs of the device. Lastly, the device according to the present invention is ideally adapted to be visually displayed on the dial of the watch piece, thus contributing significantly to the appearance of such a watch piece.

The invention claimed is:

1. A calendar display device, in particular for a mechanical watch piece comprising a watch movement, the device comprising: a first disk forming a disk of days and carrying multiple series of inscriptions symbolizing seven days of a week; a second disk forming a disk of dates and carrying inscriptions symbolizing a date of a month; a third disk forming a disk of months and carrying 12 inscriptions symbolizing months of a year, one of the disk of days and the disk of dates acting as a dial by being fixed, whereas the other of the disk of days and the disk of dates acts as a rotary disk by being arranged concentrically and rotatably in relation to said dial, said dial comprising an aperture making it possible to see the inscription of a current month on the disk of months which is mounted rotatably and is driven, either directly or indirectly, by a watch movement of said watch piece; a hand placed concentrically and rotatably in relation to said dial so as to indicate simultaneously a date and a day of the week; and a correction mechanism cooperating at least with a gear train driving the disk of months, either directly or indirectly, starting from the watch movement of said watch piece, said mechanism configured to advance and reverse the disk of months so as to allow modification of the month displayed on the dial in a bidirectional manner.

2. The device of claim 1, further comprising a correction star fixed to a correction wheel meshing with said gear train driving, either directly or indirectly, the disk of months, and a first and a second correction lever actuatable by pressure and causing, when actuated, a rotation of the correction star in the anticlockwise or clockwise direction, thus driving the disk of months through 1/12 of a turn either forwards or backwards respectively upon each actuation of one of said first or second correction levers, making it possible to change the month displayed on the dial in a bidirectional manner.

3. The device of claim 2, wherein said first and said second correction levers cause, when actuated, by means of an intermediate control, lifting of a main control cooperating with a cam of months arranged on a cam wheel in said gear train driving the disk of months, in such a way that the train of said gear train is released during a correction of the month displayed whereas the gear train and the disk of months are secured in their current position by said main control when none of the first and second levers is actuated.

4. The device of claim 1, wherein if said watch piece comprises two separate gear trains separately controlling the disk of months and the rotary disk starting from the watch movement of said watch piece, said correction mechanism is arranged so as to cooperate simultaneously with said gear train driving the disk of months and with a second gear train driving the rotary disk by the watch movement of the watch piece, in such a way that the disk of months and the rotary disk are advanced and reversed so as to make automatic the indexing between the inscriptions on said rotary disk and the inscriptions on the dial depending on the month displayed.

5. The device of claim 1, wherein if said watch piece comprises merely one gear train to control the disk of months and the rotary disk starting from the watch movement of said watch piece, the device further comprises a direct kinematic link between the disk of months and said rotary disk, or vice-versa, so as to make automatic the indexing between the inscriptions on said rotary disk and the inscriptions on the dial depending on the month displayed.

6. The device of claim 5, wherein said direct kinematic link between the disk of months and said rotary disk comprises two separate parts.

7. The device of claim 6, wherein a first part of said direct kinematic link comprises a first connecting pinion which can mesh with a second inner toothing of the disk of months, said first connecting pinion being connected to a first intermediate connecting wheel driving a second intermediate connecting wheel carrying a second connecting pinion which in turn meshes with an inner toothing of the rotary disk.

8. The device of claim 7, wherein said second inner toothing of the disk of months comprises 12 equidistant angular sectors each comprising, apart from a sector corresponding to a month of February, a succession of notches and teeth which allow the rotary disk to advance by a driving of the disk of months in such a way that indexing between the inscriptions on said rotary disk and the inscriptions on the dial is carried out automatically depending on the month displayed.

9. The device of claim 6, wherein said first part of said direct kinematic link comprises decoupling means, including a catch release mechanism, making it possible to drive the rotary disk independently of said first part of the direct kinematic link.

10. The device of claim 6, wherein a second part of said direct kinematic link comprises a four-tooth star able to cooperate with a pin fixed on the disk of months, said star being fixed to a first intermediate wheel meshing with a second intermediate wheel which is fixed to an actuating finger able to mesh with an inner toothing of the rotary disk in such a way that, upon every fourth actuation of the star by the disk of months, said rotary disk is advanced through one step so as to automatically index the inscriptions in said rotary disk and the inscriptions on the dial for a month of February in a leap year.

11. The device of claim 10, wherein at least one of said intermediate wheels comprises a toothing able to cooperate with a jumper, which holds the four-tooth star in its rest position, and arranged so that the jumper repositions the intermediate wheel with which it cooperates, after actuation of the star by said pin fixed on the disk of months, in such a position that the teeth of the four-tooth star oriented towards the disk of months are located in the path of said pin, irrespectively of the direction of rotation of the disk of months.

12. The device of claim 1, wherein said disk of months is driven by the watch movement of said watch piece by a gear train comprising a driving finger driven by said watch movement so as to carry out one rotation per month and driving a first intermediate driving wheel which meshes with a cam wheel carrying a cam of months, the cam wheel driving a second intermediate driving wheel fixed to a third intermediate driving wheel which meshes with a driving pinion carrying a driving wheel which meshes with a first inner toothing of the disk of months, in such a way that said disk of months rotates through 1/12 of a turn per month.

13. The device of claim 1, wherein said rotary disk is driven by the watch movement of said watch piece by a gear train, the disk of months being driven indirectly by a direct kinematic link arranged between said rotary disk and the disk of months.

14. The device of claim 1, wherein said second disk forms the fixed dial, said first disk being arranged as a ring which can turn around said dial, and said third disk being arranged as a ring placed concentrically and rotatably beneath said dial.

15. The device of claim 14, wherein said first disk carries five times the series of inscriptions symbolizing the seven days of the week on 35 equidistant angular sectors, said second disk carrying its inscriptions symbolizing the date of the month from 1 to 31 on 31 equidistant angular sectors of the same angular dimension as the sectors on the first disk, said aperture on the second disk being arranged between the first and last inscriptions and occupying an angular dimension corresponding to four other equidistant angular sectors of the same angular dimension as the sectors on the first disk.

16. The device of claim 1, wherein said first disk forms the fixed dial, said second disk being arranged as a ring which can turn around said dial, and said third disk being arranged as a ring arranged concentrically and rotatably beneath said dial.

17. The device of claim 1, further comprising a display of one or both of a number of a current year and a display of a current year type indicating leap years and normal years.

18. A watch piece, in particular a mechanical wristwatch, comprising the calendar display device of claim 1, the calendar display device being driven by a basic movement of the watch piece.

19. The watch piece of claim 18, wherein said first and second correction levers of the device are actuatable by corresponding first and second push-pieces of the watch piece.

* * * * *